US007320397B2

(12) United States Patent
Chao

(10) Patent No.: US 7,320,397 B2
(45) Date of Patent: Jan. 22, 2008

(54) EYEGLASSES CASE

(75) Inventor: David Chao, Saratoga, CA (US)

(73) Assignee: Contour Optik, Inc., Chiayi (TW)

( * ) Notice: Subject to any disclaimer, the term of this patent is extended or adjusted under 35 U.S.C. 154(b) by 415 days.

(21) Appl. No.: 11/145,913

(22) Filed: Jun. 6, 2005

(65) Prior Publication Data

US 2005/0286014 A1 Dec. 29, 2005

Related U.S. Application Data

(60) Provisional application No. 60/577,175, filed on Jun. 7, 2004.

(51) Int. Cl.
*A45C 11/04* (2006.01)

(52) U.S. Cl. ..... 206/5; 206/6; 206/804

(58) Field of Classification Search ..... 206/5, 206/6, 38, 216, 223, 817; 24/3.3, 3.8; 401/195; 351/63, 155, 158, 153
See application file for complete search history.

(56) References Cited

U.S. PATENT DOCUMENTS 5,878,873 A * 3/1999 Clark ..... 206/6
6,382,407 B1 * 5/2002 Chao ..... 206/5
6,616,274 B1 9/2003 Sabia et al.
2002/0157968 A1 * 10/2002 Chen ..... 206/5
2005/0155872 A1 * 7/2005 Cheng ..... 206/6

* cited by examiner

*Primary Examiner*—David T. Fidei
(74) *Attorney, Agent, or Firm*—Greenberg Traurig, LLP

(57) ABSTRACT

The present invention relates to an eyeglasses case for storing a pair of eyeglasses. More particularly, one embodiment of the present invention provides an eyeglasses case for storing a pair of eyeglasses, comprising: a first body portion, wherein the first body portion has an open end, a closed end and an elongate cavity between the open end and the closed end for receiving therein the pair of eyeglasses; a second body portion, wherein the second body portion has a first open end, a second open end and a door mounted adjacent the first open end for closing-off the first open end, wherein the second open end of the second body portion is sized to receive the open end of the first body portion therein; and an extension extending from the open end of the first body portion towards the door of the second body portion when the open end of the first body portion is received within the second open end of the second body portion; wherein movement of the first body portion into the second body portion beyond a contact point causes the extension to engage with the door of the second body portion to open the door of the second body portion.

18 Claims, 4 Drawing Sheets

EYEGLASSES CASE

RELATED APPLICATIONS

This application claims the benefit of U.S. Provisional Application Ser. No. 60/577,175, filed Jun. 7, 2004.

FIELD OF THE INVENTION

The present invention relates to an eyeglasses case for storing a pair of eyeglasses.

More particularly, one embodiment of the present invention provides an eyeglasses case for storing a pair of eyeglasses, comprising: a first body portion, wherein the first body portion has an open end, a closed end and an elongate cavity between the open end and the closed end for receiving therein the pair of eyeglasses; a second body portion, wherein the second body portion has a first open end, a second open end and a door mounted adjacent the first open end for closing-off the first open end, wherein the second open end of the second body portion is sized to receive the open end of the first body portion therein; and an extension extending from the open end of the first body portion towards the door of the second body portion when the open end of the first body portion is received within the second open end of the second body portion; wherein movement of the first body portion into the second body portion beyond a contact point causes the extension to engage with the door of the second body portion to open the door of the second body portion.

BACKGROUND OF THE INVENTION

Various types of eyeglasses cases have been proposed. Some of these proposals have even included a mechanism to open a door of the case in response to application of manual force by a user on a part of the case other than the door.

In this regard, U.S. Pat. No. 6,616,274, entitled "Ready reader eyeglasses with magnets recessed into front of frame, including carrying case and ferromagnetic strip" has disclosed that "eyeglass carrying case 29 is used by pushing slider bar 161 towards open end 104 of housing 83, which causes end portion 128 of long leg 122 to engage and open door 173 against the bias of torsion spring 194. The ready reader eyeglasses 23 can then be inserted into housing 83 and slider bar 161 moved toward closed end 101 of housing 83. This causes end portion 128 of long leg 122 to disengage from door 173, which closes under the bias of torsion spring 194. The procedure is reversed to eject eyeglasses 23 from carrying case 29, with end wall 125 bearing against eyeglasses 23 to eject them from housing 83 after door 173 is opened."

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Figure 1:
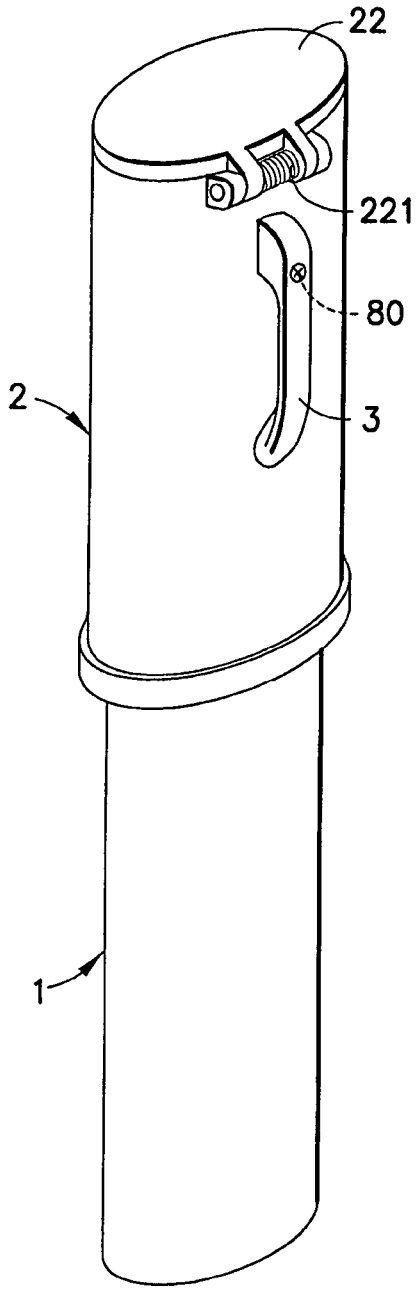
FIG. 1 shows a perspective view of an eyeglasses case according to an embodiment of the present invention (wherein the eyeglasses case is in a closed position)
Figure 2:
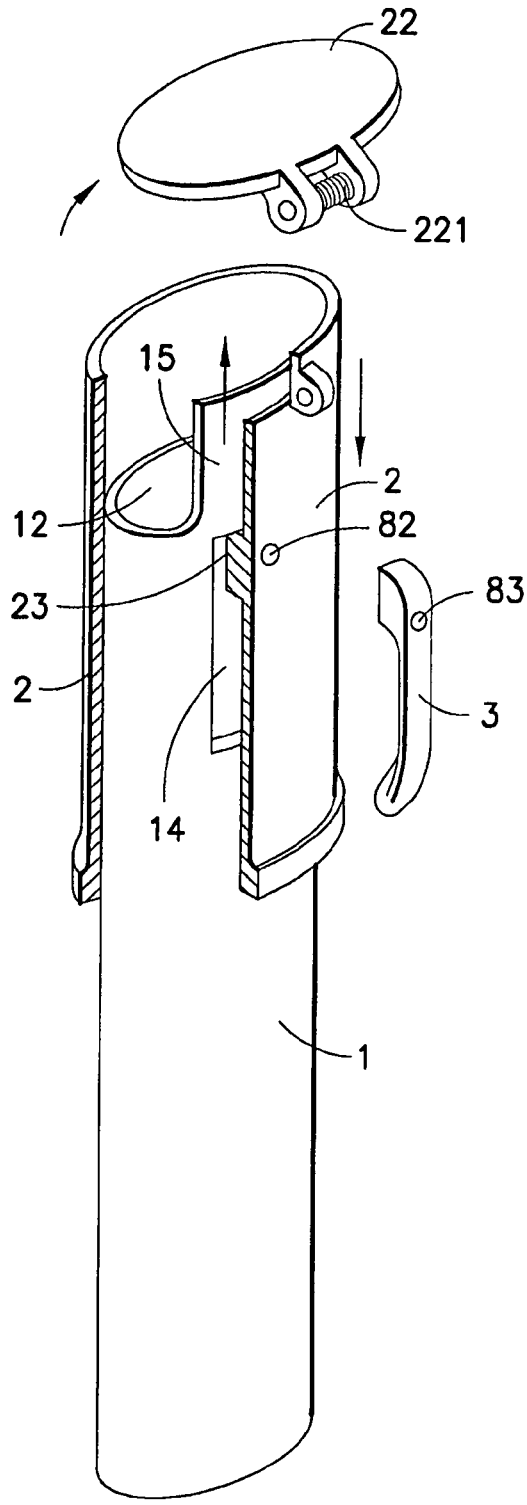
FIG. 2 shows a partially cut-away, partially exploded perspective view of the eyeglasses case of FIG. 1 (wherein the door and the clip are not attached to the eyeglasses case)
Figure 3:
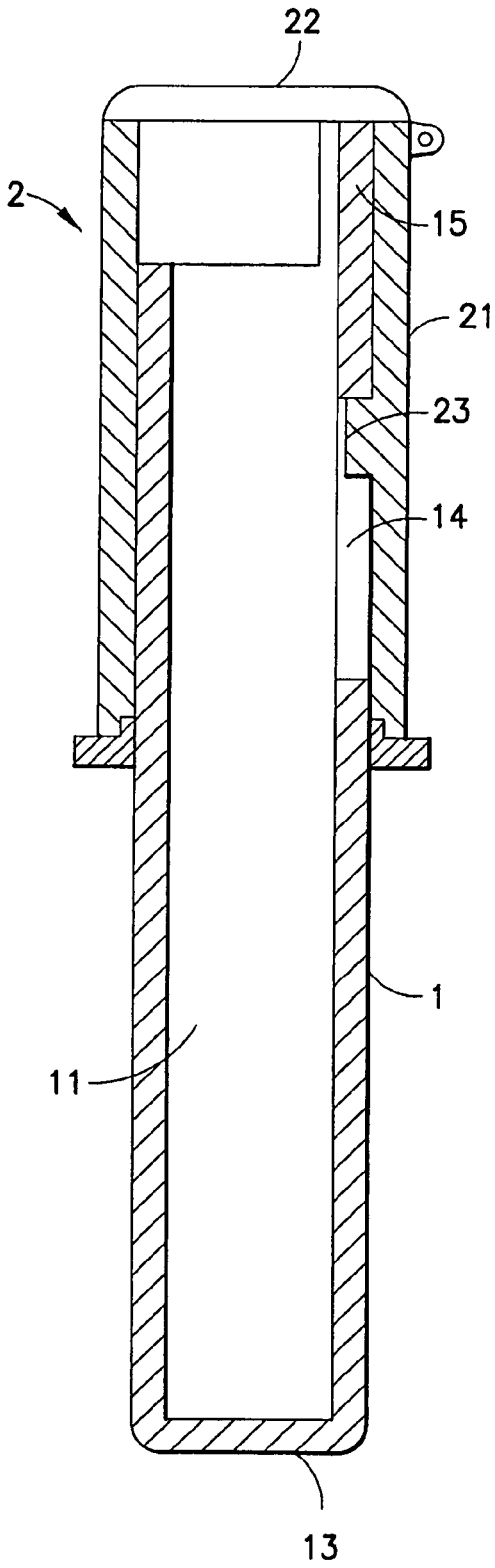
FIG. 3 shows a cut-away view of the eyeglasses case of FIGS. 1 and 2 (wherein the eyeglasses case is in a closed position)

Referring now to FIGS. 1-3, an eyeglasses case according to one embodiment of the present invention is shown. More particularly, it is seen that the eyeglasses case of this embodiment includes Housing Body Portion 1 and Covering Body Portion 2. Housing Body Portion 1 comprises Elongate Cavity 11 (formed by the walls of Housing Body Portion 1) for removably storing therein a pair of eyeglasses (not shown). Further, Housing Body Portion 1 comprises Open End 12, Bottom End 13, Slot 14 and Extension 15 (extending from the upper end of Housing Body Portion 1).

Still referring to FIGS. 1-3, it is seen that Covering Body Portion 2 comprises Cap 21 telescoped over Housing Body Portion 1. Further, Cap 21 includes Door 22 and Stopper 23. Moreover, Clip 3 is attached to Cap 21.

In operation, the eyeglasses case of this embodiment may be used by moving Covering Body Portion 2 to the position where Stopper 23 is disposed at the bottom end of Slot 14 (i.e., toward Bottom End 13 of Housing Body Portion 1). This causes Extension 15 to push against and open Door 22 such that a pair of eyeglasses (not shown) may be inserted into the eyeglasses case (e.g., for storage) or removed from the eyeglasses case (e.g., for wearing). Of course, moving Covering Body Portion 2 to the position where Stopper 23 is disposed at the top end of Slot 14 (i.e., toward Open End 12 of Housing Body Portion 1) will result in Extension 15 disengaging from Door 22. Door 22 will then close due to the bias of Spring 221. In one example (which example is intended to be illustrative and not restrictive), Spring 221 may be a torsion spring (as shown in FIG. 6).

Figure 4:
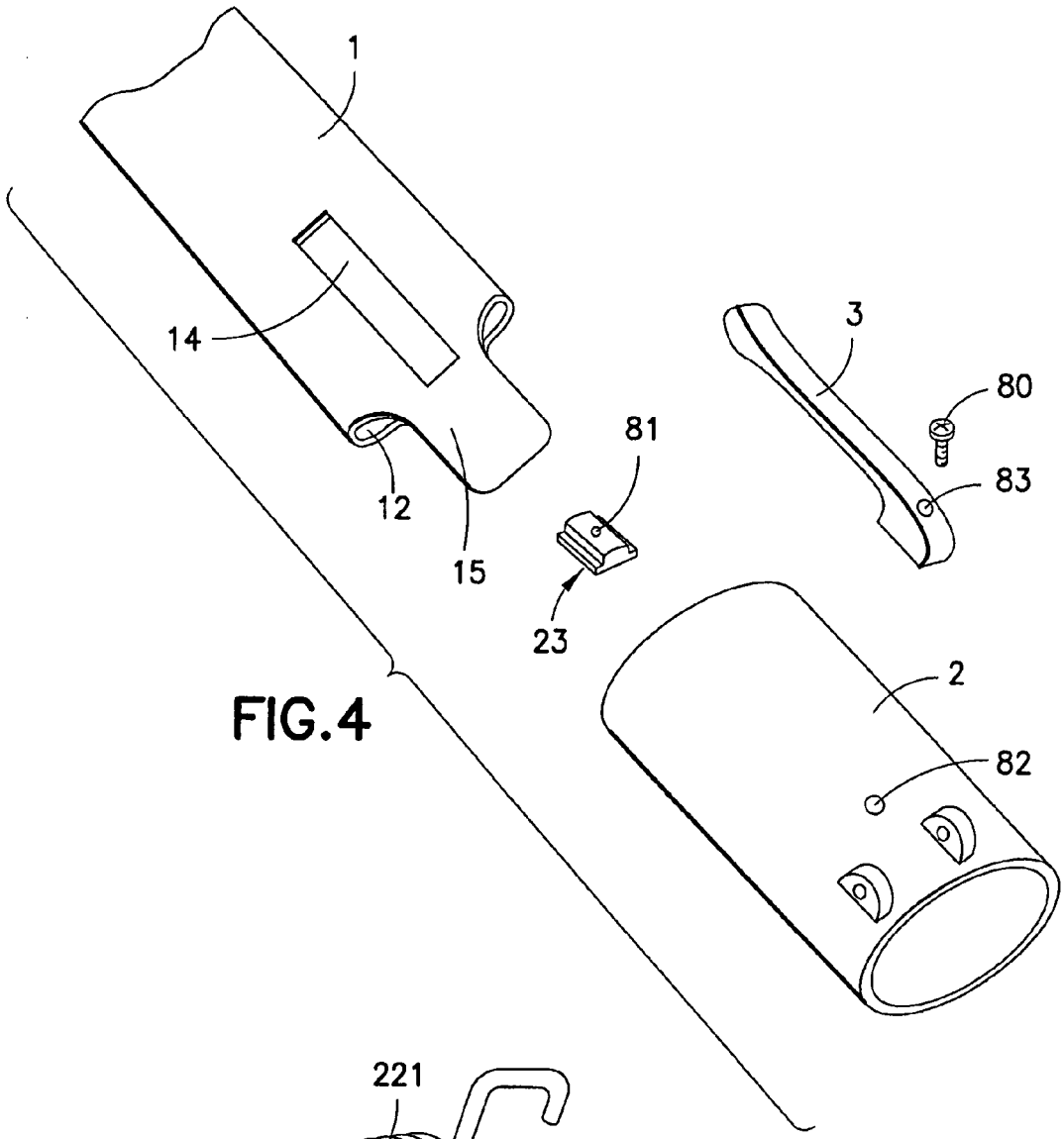
FIG. 4 shows an exploded perspective view of certain parts of the eyeglasses case of FIGS. 1-3.

Referring now to FIG. 4, an exploded perspective view of certain parts of the eyeglasses case of FIGS. 1-3 is shown. More particularly, it is seen that Clip 3 may be attached to Cap 21 via Screw 80 inserted through Clip 3 and First Hole 82 into Second Hole 81 disposed in Stopper 23. In this manner both Clip 3 and Stopper 23 may be mounted to Cap 21. In another example (which example is intended to be illustrative and not restrictive), one or both of Clip 3 and Stopper 23 may be formed integrally with Cap 21.

Figure 5:
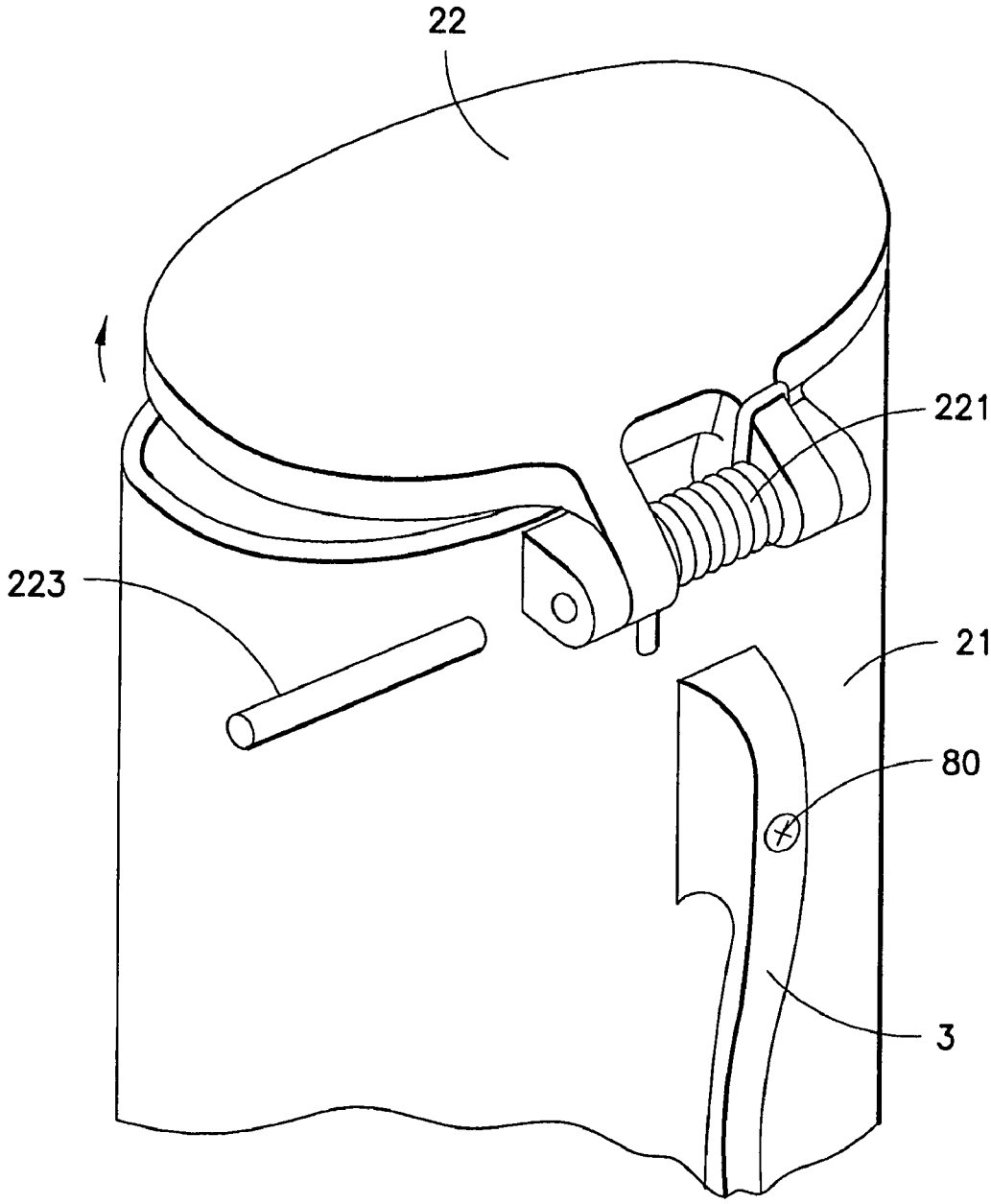
FIG. 5 shows a detail view of certain parts of the eyeglasses case of FIGS. 1-4.

Referring now to FIG. 5, a detail view of certain parts of the eyeglasses case of FIGS. 1-4 is shown. More particularly, Door 22 may be held in place on Cap 21 via Pin 223.

Figure 6:
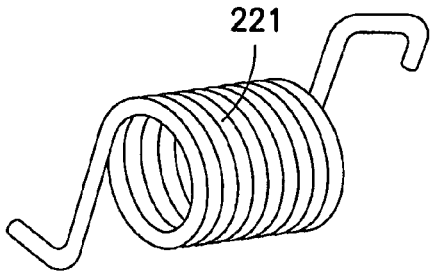
FIG. 6 shows a detail view of the spring mechanism of the eyeglasses case of FIGS. 1-5.

Referring now to FIG. 6, a detail view of Spring 221 of the eyeglasses case of FIGS. 1-5 is shown (in this example the Spring 221 is of a torsion type—of course, other types of springs or biasing mechanisms may be used).

While a number of embodiments of the present invention have been described, it is understood that these embodiments are illustrative only, and not restrictive, and that many modifications may become apparent to those of ordinary skill in the art. For example, the door may be biased closed by a spring, by another type of biasing mechanism and/or by manual actuation. Further, the two body portions may be biased away from one another by the pressure of the door on the extension and/or by another bias mechanism.

What is claimed is:

1. An eyeglasses case for storing a pair of eyeglasses, comprising:

a first body portion, wherein the first body portion has an open end, a closed end and an elongate cavity between the open end and the closed end for receiving therein the pair of eyeglasses;

a second body portion, wherein the second body portion has a first open end, a second open end and a door mounted adjacent the first open end for closing-off the first open end, wherein the second open end of the second body portion is sized to receive the open end of the first body portion therein; and an extension extending from the open end of the first body portion towards the door of the second body portion when the open end of the first body portion is received within the second open end of the second body portion;

wherein movement of the first body portion into the second body portion beyond a contact point causes the extension to engage with the door of the second body portion to open the door of the second body portion.

2. The eyeglasses case of claim 1, wherein the door is mounted to the second body portion by a hinge.

3. The eyeglasses case of claim 2, wherein the extension is configured to engage the door adjacent the hinge.

4. The eyeglasses case of claim 3, wherein the door is biased closed by a spring.

5. The eyeglasses case of claim 4, wherein the spring is a torsion spring mounted on the hinge.

6. The eyeglasses case of claim 1, wherein the second body portion includes a stopper and the first body portion includes a slot configured to receive the stopper.

7. The eyeglasses case of claim 6, wherein the stopper and the slot cooperate to provide two movement limits which limit the relative movement between the first body portion and the second body portion.

8. The eyeglasses case of claim 7, wherein a first one of the movement limits permits the door to be fully closed and a second one of the movement limits permits the door to be fully open.

9. The eyeglasses case of claim 8, wherein the door is in an intermediate position between fully open and fully closed when neither of the two movement limits provided by the slot and the stopper have been reached.

10. The eyeglasses case of claim 1, further comprising a clip mounted to at least one of the first body portion and the second body portion.

11. The eyeglasses case of claim 10, wherein the clip is mounted to the second body portion.

12. An eyeglasses case for storing a pair of eyeglasses, comprising:

a first body portion, wherein the first body portion has an open end, a closed end and an elongate cavity between the open end and the closed end for receiving therein the pair of eyeglasses;

a second body portion, wherein the second body portion has a first open end, a second open end and a door mounted adjacent the first open end via a hinge for closing-off the first open end, wherein the second open end of the second body portion is sized to receive the open end of the first body portion therein;

a stopper associated with the second body portion being received by a slot associated with the first body portion; and an extension extending from the open end of the first body portion towards the door of the second body portion when the open end of the first body portion is received within the second open end of the second body portion;

wherein movement of the first body portion into the second body portion beyond a contact point causes the extension to engage with the door of the second body portion at a position adjacent the hinge to open the door of the second body portion; and wherein the stopper and the slot cooperate to provide two movement limits which limit the relative movement between the first body portion and the second body portion.

13. The eyeglasses case of claim 12, wherein the door is biased closed by a spring.

14. The eyeglasses case of claim 13, wherein the spring is a torsion spring mounted on the hinge.

15. The eyeglasses case of claim 12, wherein a first one of the movement limits permits the door to be fully closed and a second one of the movement limits permits the door to be fully open.

16. The eyeglasses case of claim 15, wherein the door is in an intermediate position between fully open and fully closed when neither of the two movement limits provided by the slot and the stopper have been reached.

17. The eyeglasses case of claim 12, further comprising a clip mounted to at least one of the first body portion and the second body portion.

18. The eyeglasses case of claim 17, wherein the clip is mounted to the second body portion.

* * * * *